US005429087A

United States Patent [19]

Tsujino et al.

[11] Patent Number: 5,429,087

[45] Date of Patent: Jul. 4, 1995

[54] THROTTLE BODY FOR TRACTION CONTROL

[75] Inventors: Mutsumi Tsujino; Noboru Ishihara; Sunao Kitamura, all of Obu, Japan

[73] Assignee: Aisan Kogyo Kabushiki Kaisha, Obu, Japan

[21] Appl. No.: 274,803

[22] Filed: Jul. 14, 1994

[30] Foreign Application Priority Data

Jul. 16, 1993 [JP] Japan ..... 5-176791
Jul. 20, 1993 [JP] Japan ..... 5-179336
Oct. 28, 1993 [JP] Japan ..... 5-270477

[51] Int. Cl.[6] ..... F02D 9/00
[52] U.S. Cl. ..... 123/336
[58] Field of Search ..... 123/336, 337, 352, 399, 123/319; 364/426.02, 426.03; 180/197, 233

[56] References Cited

U.S. PATENT DOCUMENTS 4,637,487 1/1987 Nakamura et al. ..... 180/197
4,722,411 2/1988 Ohashi et al. ..... 180/197
4,771,850 9/1988 Matsuda ..... 123/336
5,105,360 4/1992 Akiyama ..... 364/426.03

FOREIGN PATENT DOCUMENTS 62-141311 3/1989 Japan ..... 123/336
62-1413113 3/1989 Japan ..... 123/336
3-290042 12/1991 Japan ..... 123/336
3-290042 12/1991 Japan ..... 123/336

*Primary Examiner*—Raymond A. Nelli
*Attorney, Agent, or Firm*—Dennison, Meserole, Pollack & Scheiner

[57] ABSTRACT

A throttle body for traction control includes a secondary throttle shaft, a secondary throttle valve rotatable with the secondary throttle shaft to open and close a throttle bore, and a motor adapted to rotate the secondary throttle shaft for opening and closing the secondary throttle valve. The motor for opening and closing the secondary throttle valve has an output shaft coaxially disposed with the secondary throttle shaft. The output shaft and the secondary throttle shaft are connected by means of a coupling. The secondary throttle shaft is offset from the axis of symmetry of the throttle bore. The secondary throttle valve is divided by the secondary throttle shaft and defines a section which is longer in dimension from the secondary throttle shaft to the end of the secondary throttle valve and another section which is shorter. The longer section is disposed downstream in air flow, so that air flowing through the throttle bore exerts on the secondary throttle valve a force acting to open the same.

6 Claims, 13 Drawing Sheets

THROTTLE BODY FOR TRACTION CONTROL

BACKGROUND OF THE INVENTION

1. Field of the Invention

The present invention relates to a throttle body to be used for adjusting output of an engine, and more specifically to a throttle body for traction control provided with a main throttle valve which is opened and closed through operation of an accelerator and with a secondary throttle valve which is opened and closed by means of a motor.

2. Description of the Prior Art

A throttle body for traction control provided with a main throttle valve and a secondary throttle valve has been often used, and a structure which constitutes the basis of the present invention is disclosed in Japanese Laid-Open Utility Model Publication No. 64-46443. The structure includes a speed reducer interposed between a shaft for a secondary throttle valve and an output shaft of a motor for opening and closing the secondary throttle valve, so that a requisite torque for opening and closing the secondary throttle valve is obtainable through the speed reducer. To assure fail-safe operation, the secondary throttle valve is required to be opened when the motor for opening and closing the secondary throttle valve is in trouble. When the motor is in trouble, closing of a throttle bore by the secondary throttle valve would cause stoppage of the engine, while opening thereof by the secondary throttle valve permits adjustment of the engine output through a main throttle valve. For this purpose, a return spring is mounted on the secondary throttle shaft so as to urge the secondary throttle valve toward its fully opened position. Then, the motor for opening and closing the secondary throttle valve is required to produce a torque large enough to close the secondary throttle valve against the biasing force of the return spring. The technique disclosed in the above Japanese Laid-Open Utility Model Publication No. 64-46443 employs the speed reducer, which permits a relatively small motor to be used as the motor for opening and closing the secondary throttle valve.

This technique allows the motor for opening and closing the secondary throttle valve to be made smaller, but requires provision of the speed reducer. This results in addition of a manufacturing cost of the speed reducer to the whole cost of manufacturing the throttle body. Furthermore, an additional space for installing the speed reducer is necessary, which will be disadvantageous to make the throttle body smaller.

Japanese Laid-Open Patent Publication No. 3-290042 discloses another structure in which a secondary throttle shaft and an output shaft of a motor for opening and closing the secondary throttle valve are directly connected by means of a coupling which can transmit torque therebetween, with no speed reducer interposed between the shafts. This structure is effective to solve the above problem. In this structure with no speed reducer, however, the motor for opening and closing the secondary throttle valve is required to close the secondary throttle valve directly against the biasing force of the return spring, so that the motor must produce a larger torque. Thus, this structure requires provision of a larger motor.

SUMMARY OF THE INVENTION

A primary object of the present invention is to provide a structure in which a motor for opening and closing a secondary throttle valve is required to produce a smaller torque, so that a smaller motor can be used for opening and closing the secondary throttle valve, with no provision of a speed reducer required.

Another object of the present invention is to reduce the number of parts required to manufacture a throttle body.

A further object of the present invention is to improve adjusting accuracy of the engine output by the secondary throttle valve.

According to an aspect of the present invention, a secondary throttle shaft and an output shaft of a motor for opening and closing a secondary throttle valve are coaxially disposed and connected with each other by means of a coupling which can transmit torque therebetween. No speed reducer is provided. The secondary throttle shaft is offset from the axis of symmetry of a throttle bore, defining a section which is longer in dimension from the secondary throttle shaft to the end of the secondary throttle valve and another section which is shorter. The longer section is disposed downstream in air flow. With this arrangement in which the longer section is disposed downstream in the air flow and the shorter section is disposed upstream in the air flow, the air flowing through the throttle bore exerts on the secondary throttle valve a force acting to open it. Thus, there is no need of a return spring for urging the secondary throttle valve toward its fully-opened position, and the torque to be produced by the motor for opening and closing the secondary throttle valve is reduced. Thus, according to the present invention, a smaller motor can be used as the motor for opening and closing the secondary throttle valve, without any speed reducer.

Preferably, a main throttle sensor for detecting the opening degree of the main throttle valve and a secondary throttle sensor for detecting the opening degree of the secondary throttle valve are disposed on opposite sides of the throttle body casing. With this arrangement, the main throttle sensor and the secondary throttle sensor can be of the same construction. Thus, the number of kinds of parts can be reduced.

Preferably, the secondary throttle sensor is provided with a switch for detecting the fully opened condition. This switch is effective to improve adjusting accuracy of the engine output.

The present invention will be more fully understood from the following detailed description and appended claims when taken with the accompanied drawings.

DETAILED DESCRIPTION OF THE PREFERRED EMBODIMENTS (First Embodiment)

Figure 1:
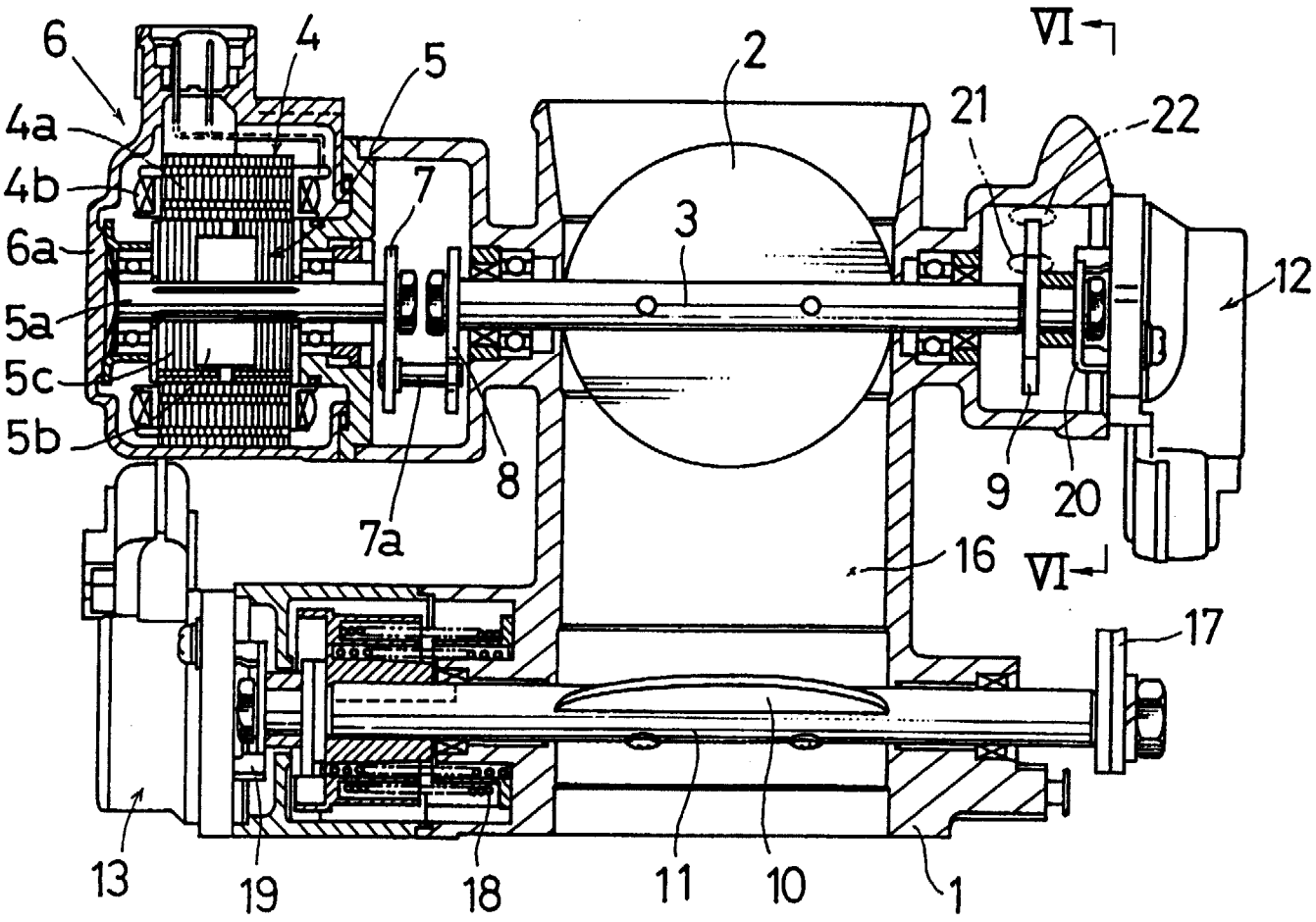
FIG. 1 is a front sectional view of a throttle body for traction control according to a first embodiment of the invention.

Now, a throttle body for traction control according to a first embodiment of the invention will be described with reference to FIGS. 1 to 6. FIG. 1 is a front sectional view of the throttle body including a throttle body casing 1 which is a substantially cylindrical member having a throttle bore 16 through which intake air of an automobile engine flows. The throttle body casing 1 carries a secondary throttle shaft 3 and a main throttle shaft 11 disposed downstream of and parallel to the secondary throttle shaft 3, both shafts being pivotally supported through respective bearings (unnumbered). The throttle shafts 3 and 11 support a secondary throttle valve 2 and a main throttle valve 10, respectively, adapted for opening and closing the throttle bore 16. Each of the throttle shafts 3 and 11 has opposite ends protruding beyond a side surface of the throttle body casing 1.

Figure 2:
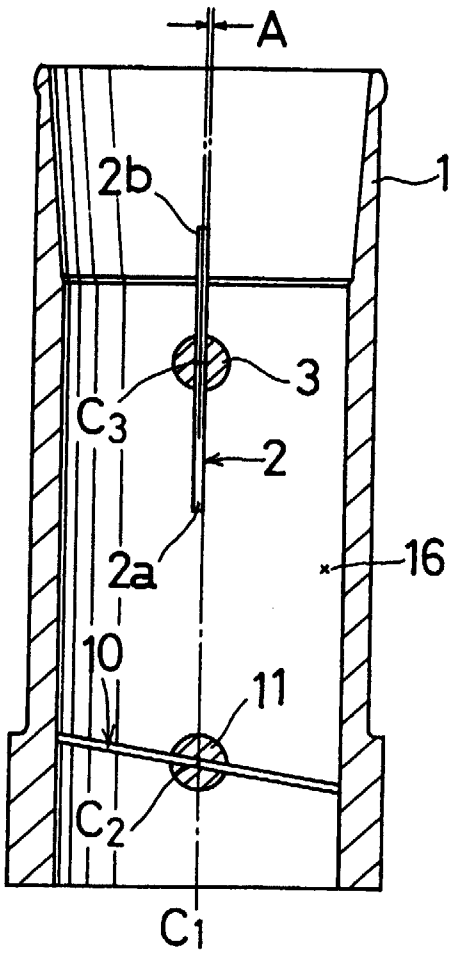
FIG. 2 is a side sectional view of the throttle body in FIG. 1.

As shown in FIG. 2 which is a side sectional view, the secondary and main throttle shaft 3 and 11 are disposed in relation to the axis of symmetry C1 of the throttle bore 16 as follows. Specifically, the main throttle shaft 11 has a central axis C2 which is on the symmetric axis C1 of the throttle bore 16. The secondary throttle shaft 3 has a central axis C3 which is offset from the symmetric axis C1 of the throttle bore 16 by a distance A. Thus, the secondary throttle valve 2 is mounted in such a manner that an opening end portion 2*a* more apart from the central axis C3 of the secondary throttle shaft 3 is located downstream of air flow in comparison to an opposite opening end portion 2*b* less apart from the central axis C3.

In FIG. 1, an accelerator lever 17 is attached to an end (right end as viewed in the drawing) of the main throttle shaft 11. The accelerator lever 17 is connected with an accelerator cable (not shown) which extends between an accelerator pedal (not shown) and the throttle body. The main throttle shaft 11 is provided at the other end thereof with a main return spring 18 disposed so as to urge the main throttle valve 10 toward its closed position. A sensor lever 19 is attached to the other end of the main throttle shaft 11. A main throttle sensor 13 is mounted on the side wall of the throttle body casing 1 at the other end of the main throttle shaft 11. The main throttle sensor 13 has a detection lever (not shown) which is engaged with the sensor lever 19. The throttle sensor 13 detects the opening degree of the main throttle valve 10 in accordance with the pivotal movement of the main throttle shaft 11, and transmits a detection signal to a controller ECU (not shown).

The main throttle valve 10 is normally in its fully closed position corresponding to an idle opening degree under the biasing force of the main return spring 18, and can be pivotally moved to a desired opening degree in association with the operation of the accelerator.

Figure 6:
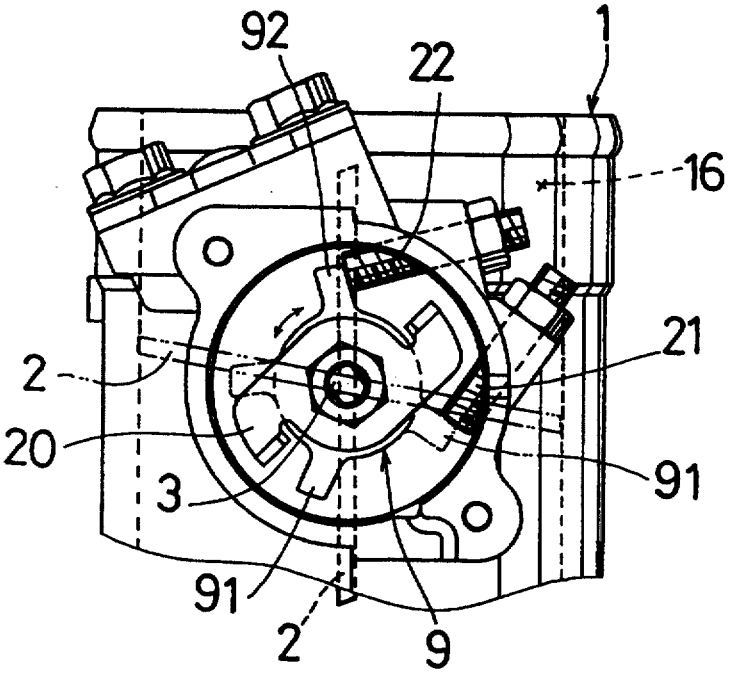
FIG. 6 is a sectional view taken along line VI—VI in FIG. 1.

A position restricting lever 9 is attached to an end (right end as viewed in the drawing) of the secondary throttle shaft 3. As shown in FIG. 6, the position restricting lever 9 has a pair of projections 91 and 92. As shown by dotted lines in FIG. 6, when the secondary throttle valve 2 is fully closed, the projection 91 comes in abutment against a full closing stopper 21 mounted on the throttle body casing 1 to prevent further closing movement of the secondary throttle valve 2. On the other hand, as shown by solid lines in FIG. 6, when the secondary throttle valve 2 is fully opened, the projection 92 comes in abutment against a full opening stopper 22 mounted on the throttle body casing 1 to prevent further opening movement of the secondary throttle valve 2.

A sensor lever 20 is attached to the one end of the secondary throttle shaft 3. As shown in FIG. 1, a secondary throttle sensor 12 is mounted on the side surface of the throttle body casing 1 at the one end of the secondary throttle shaft 3, and has a detection lever (not shown) which is engaged with the sensor lever 20. The secondary throttle sensor 12 detects the opening degree of the secondary throttle valve 2 in accordance with the pivotal movement of the secondary throttle shaft 3, and transmits a detection signal to the controller ECU.

A motor 6 for opening and closing the secondary throttle valve 2 is mounted on the side surface of the throttle body casing 1 at the other end (left end as viewed in the drawing) of the secondary throttle shaft 3 and disposed coaxially therewith. The motor 6 is constituted by a hybrid step motor which is a self-contained motor unit including a motor housing 6*a* to be attached to the side surface of the throttle body casing 1, a rotor 5 rotatably supported through a bearing within the housing 6*a* and a stator 4 disposed around the rotor 5 in the housing 6*a*. The rotor 5 is composed of an output shaft 5*a* to which a magnet 5*b* and a rotor core 5*c* are coupled, and when a driving pulse signal is transmitted to a coil 4*b* wound around a stator core 4*a*, the rotor 5 is rotated through a predetermined angle in response to the signal.

Figure 5A:
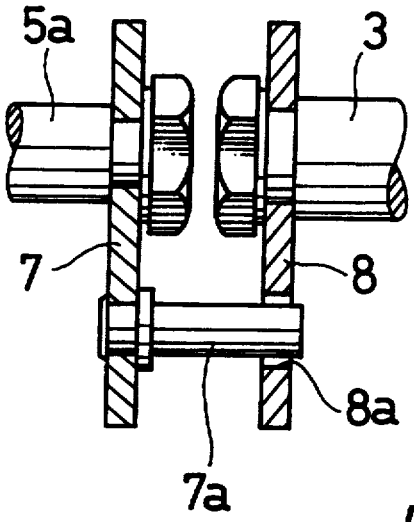
FIGS. 5(*a*) and 5(*b*) are views illustrating a coupling.
Figure 5B:
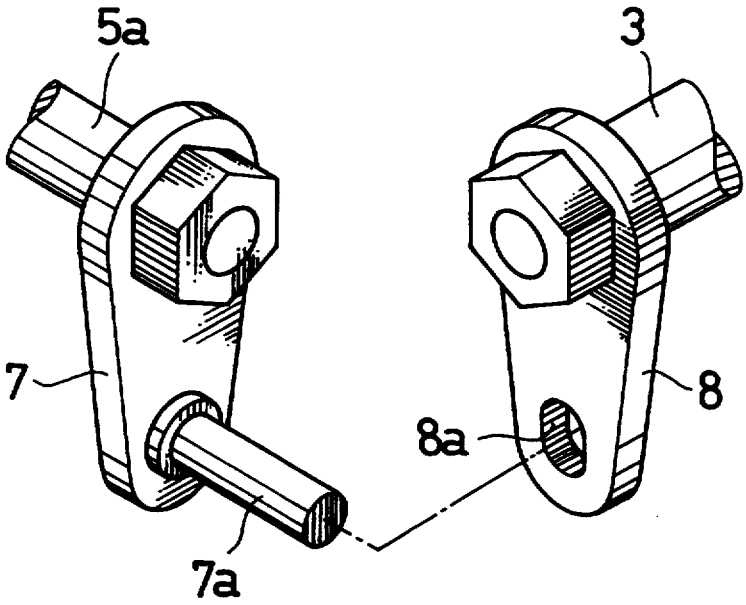

The output shaft 5*a* of the motor 6 and the secondary throttle shaft 3 are coupled to each other through a coupling provided in a vacant space defined between the throttle body casing 1 and the motor housing 6*a* and adapted to transmit torque therebetween. The coupling is shown in FIGS. 5(*a*) which is a sectional view and 5(*b*) which is an exploded perspective view.

The motor 6 has a lever 7 attached by a screw to an end of the output shaft 5*a* adjacent to the secondary throttle shaft 3 and extending radially of the output shaft 5*a*. A connecting pin 7*a* is attached to the distal end of the lever 7 and extends parallel to the output shaft 5*a* in the direction away from the motor 6.

The secondary throttle valve 2 has a lever 8 attached by a screw to a corresponding end of the secondary throttle shaft 3 and extending radially of the secondary throttle shaft 3. The lever 8 has at the distal end thereof a connecting hole 8*a* in which the distal end of the connecting pin 7*a* is engaged. Thus, the rotation of the output shaft 5a is directly transmitted to the secondary throttle shaft 3 at 1:1 rotational ratio.

The motor 6 for opening and closing the secondary throttle valve 2 is operated in response to a signal from the controller ECU to open or close the secondary throttle valve 2 to a predetermined opening degree and normally keeps the throttle valve 2 in its fully opened condition.

Figure 3:
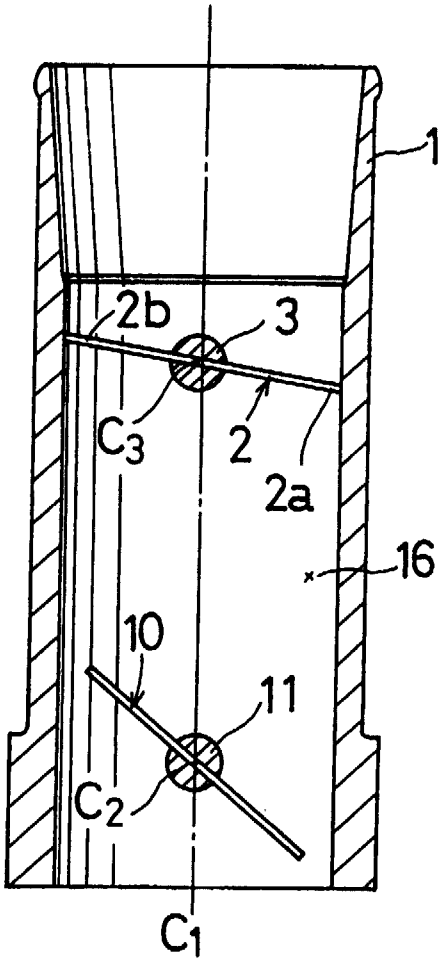
FIG. 3 is a view similar to FIG. 2, illustrating the traction control condition by the throttle body.

The throttle body for traction control of this construction operates in such a manner that, in a non-driving condition, the main throttle valve 10 is in its fully closed position and the secondary throttle valve 2 is in its fully opened condition, as shown in FIG. 2. In the normal driving condition, the main throttle valve 10 is pivotally moved to a desired opening degree in association with the operation of the accelerator. When the controller ECU detects an excessive engine output condition, it directs the motor 6 to close the secondary throttle valve 2 in response to the detection so as to restrict the engine output or, in other words, to achieve traction control. This condition is shown in FIG. 3. When the traction control is completed, the secondary throttle valve 2 is returned to its initial position (fully opened position) under the control of the motor 6 by the controller ECU.

Figure 4:
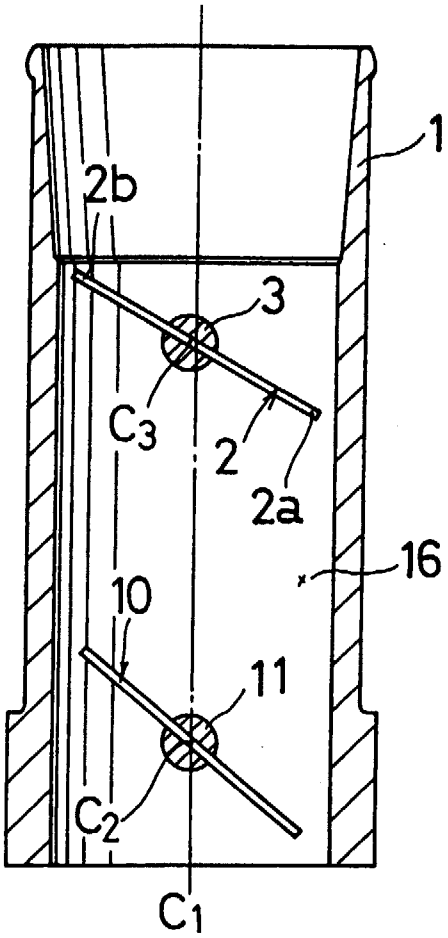
FIG. 4 is a view similar to FIG. 3, illustrating the fail-safe operation of the throttle body.

If there should happen inability to open or control the secondary throttle valve 2, during closing control thereof, due to any troubles such as breaking of the coil of the motor 6, the throttle body of the present invention permits a fail-safe drive of the automobile. Specifically, because of the offset arrangement of the secondary throttle shaft 3 of the secondary throttle valve 2, a negative pressure in a suction pipe of the engine acts on the secondary throttle valve 2 under the closing control in such a manner as to open the valve in the clockwise direction in FIG. 3. Therefore, in the event of uncontrollability of the secondary throttle valve 2 occurring during the closing control, the secondary throttle valve 2 is led to be opened, as shown in FIG. 4, by the negative pressure in the suction pipe of the engine, and fail-safe drive becomes possible by the operation of the main throttle valve 10 controlled by the accelerator. In the uncontrollable condition, current flow to the motor 6 is disconnected by the controller ECU.

In the throttle body for traction control of this construction, rotation of the rotor 5 caused by energization of the motor 6 is coaxially transmitted from the output shaft 5a through the coupling including the levers 7 and 8 to the secondary throttle shaft 3, and consequently, there is no need of a speed reducer which has been provided in the conventional throttle body, resulting in so much reduction of the dimension of the throttle body. Furthermore, the throttle body is inexpensive to manufacture because of no provision of a speed reducer. Since the offset arrangement of the secondary throttle valve 2 causes the suction air flow to produce a force acting to fully open the valve, the throttle body can also eliminate a secondary return spring for urging the secondary throttle valve 3 to its fully opened position which has been required in the conventional throttle body. Thus, the secondary throttle valve 2 can be opened and closed with no biasing force applied by the secondary return spring. As the result, the motor 6 is not required to produce an amount of torque to be used for overcoming the biasing force of the secondary return spring, permitting so much reduction of the load on the motor. It also becomes possible to use a small motor as the motor for opening and closing the secondary throttle valve.

Furthermore, as described above, owing to the offset arrangement of the secondary throttle shaft 3 of the secondary throttle valve 2, the fail-safe drive is assured by operation of the main throttle valve 10 controlled by the accelerator in the event of uncontrollability of the secondary throttle valve 2 during the closing control thereof, and, thus, the fail-safe construction including no secondary return spring is achieved.

Since the output shaft 5a of the motor 6 and the secondary throttle shaft 3 are coaxially coupled with each other through the coupling including the levers 7 and 8, the motor 6 which is a self-contained motor unit can be mounted on the throttle body casing 1. The motor 6 can be so constructed as to define a small air gap between the rotor and the stator in comparison to a motor having a motor shaft which is an extension of the secondary throttle shaft 3, permitting effective takeout of the torque performance of the motor. This is especially advantageous, when a hybrid step motor in which a small air gap is required is used as the motor 6, and a high control resolution characteristic of the hybrid step motor enhances the high degree of control accuracy of air flow by the secondary throttle valve 2.

(Second Embodiment)

Figure 7A:
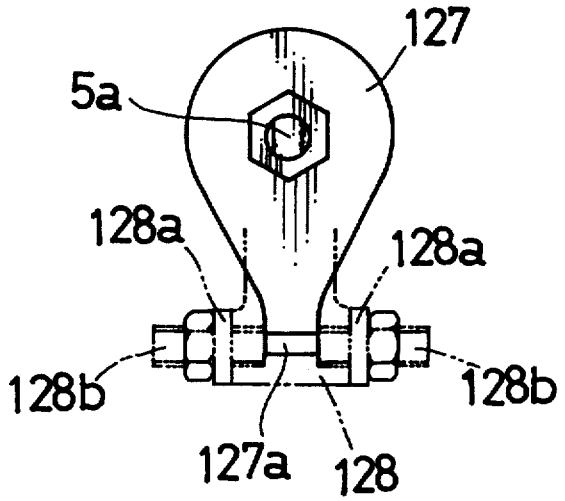
FIGS. 7(*a*) and 7(*b*) are views illustrating the coupling according to a second embodiment.
Figure 7B:
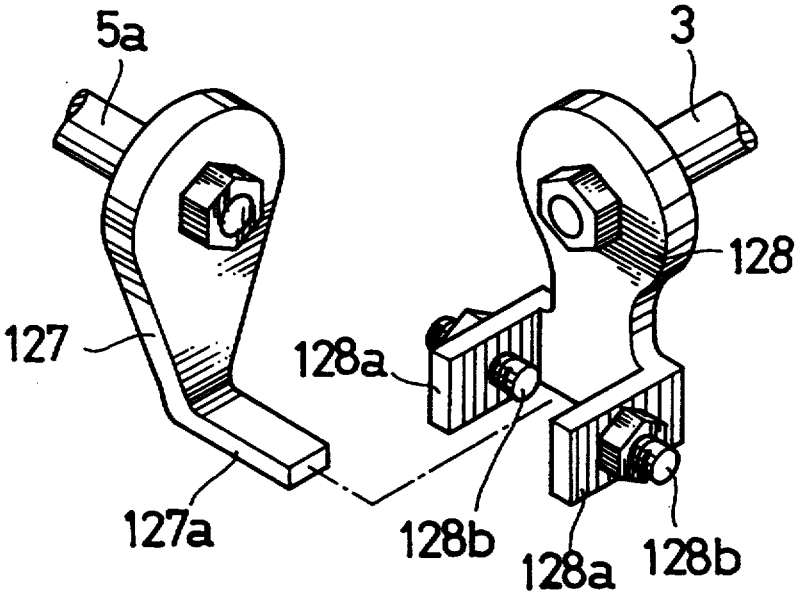

Now, a second embodiment of the invention will be described with reference to FIGS. 7(*a*) and 7(*b*). This embodiment is a partly modified structure of the first embodiment, and the modified part will be described in detail. Any duplicating description as to the other parts which are believed to be similar or equivalent to those in the first embodiment will be omitted. Similarly, any duplicating description will be omitted in following embodiments. FIG. 7(*a*) is a front view of a lever attached to the motor, and FIG. 7(*b*) is an exploded perspective view of a coupling.

This embodiment is a modification of the coupling of the first embodiment, as shown in FIGS. 7(*a*) and 7(*b*).

The motor has a lever 127 attached by a screw to an end of the output shaft 5a adjacent to the secondary throttle shaft 3. The lever 127 has at the distal end thereof a connecting piece 127a extending parallel to the output shaft 5a in the direction away from the motor 6.

The secondary throttle valve 2 has a lever 128 attached by a screw to a corresponding end of the secondary throttle shaft 3. The lever 128 has at the distal end thereof opposite mounting pieces 128a formed so as to receive the connecting piece 127a therebetween, and a threaded rod 128b is threadedly engaged in each of the mounting pieces 128a. The connecting piece 127a is held tightly between the two threaded rods 128b with no backlash.

(Third Embodiment)

Figure 8A:
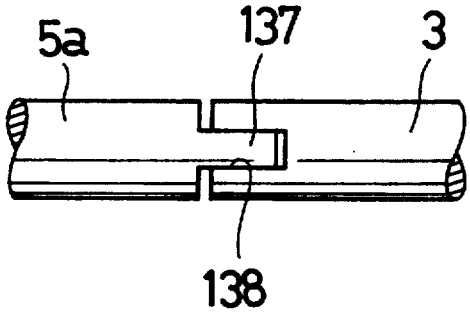
FIGS. 8(*a*) and 8(*b*) are views illustrating the coupling according to a third embodiment.
Figure 8B:
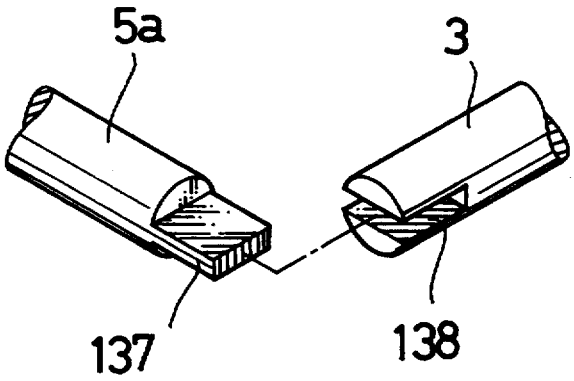

A third embodiment of the invention is shown in FIGS. 8(*a*) and 8(*b*). FIG. 8(*a*) is a front view of a modified coupling, and FIG. 8(*b*) is an exploded perspective view thereof.

This embodiment is modified connecting means as shown in FIG. 8.

The output shaft 5a has at one end thereof a connecting projection 137 which is engaged in a connecting slot 138 formed in a corresponding end of the secondary throttle shaft 3.

(Fourth Embodiment)

Figure 9:
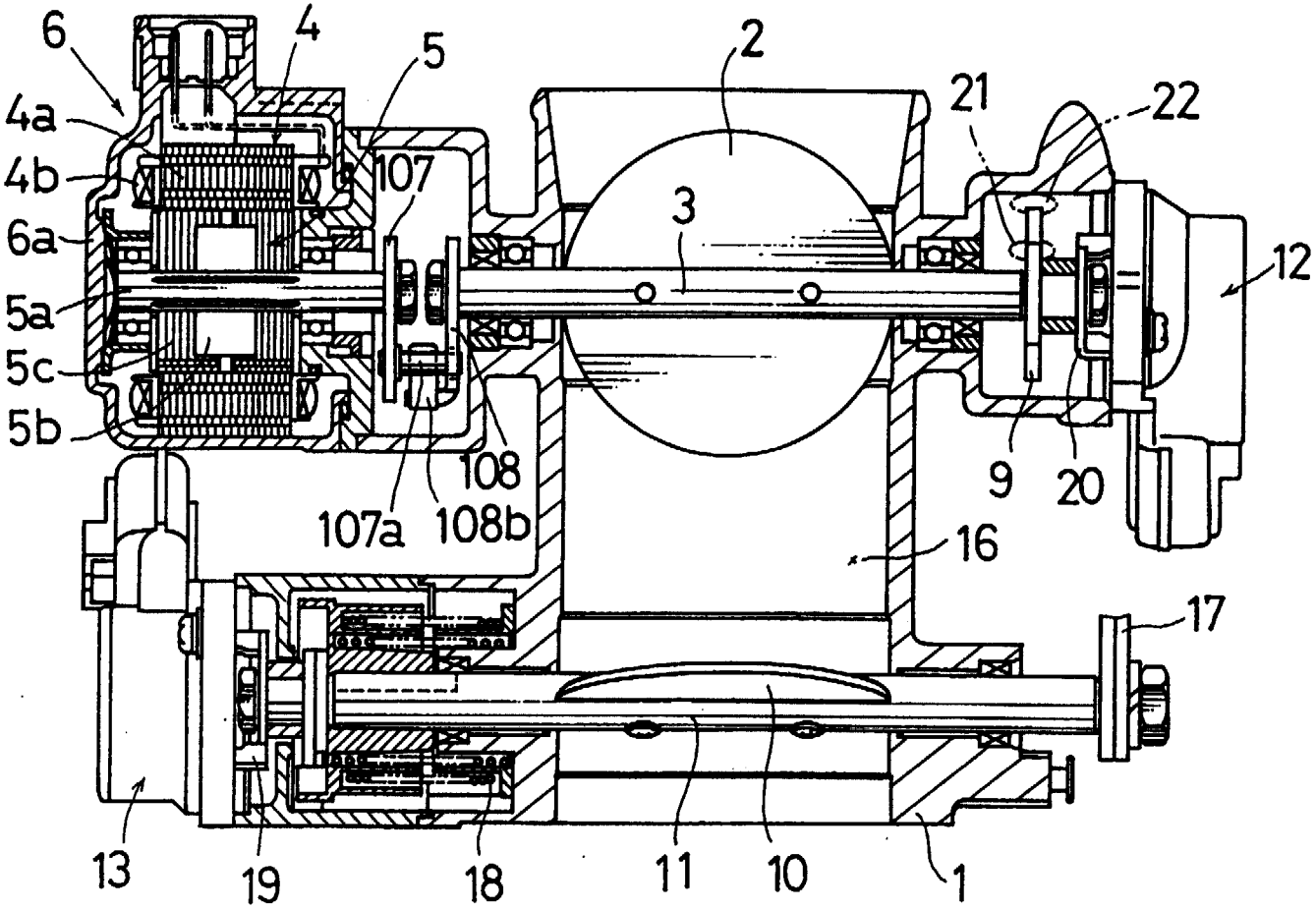
FIG. 9 is a front sectional view of the throttle body for traction control including the coupling of a fourth embodiment.

A fourth embodiment of the invention will be described with reference to FIG. 9 and FIGS. 10(*a*), 10(*b*)

and 10(*c*). FIG. 9 is a front sectional view of the throttle body for traction control, and FIG. 10(*a*) is a sectional view of a modified coupling, FIG. 10(*b*) is a front view of a lever attached to the motor, and FIG. 10(*c*) is a front view of a lever attached to the secondary throttle valve.

The embodiment is an improvement of the coupling in the first embodiment. As shown in FIG. 9 and FIGS. 10(*a*), 10(*b*) and 10(*c*), a lever 108 is attached to the secondary throttle valve and has at the distal end thereof a bent piece **108*c* projecting toward the motor, and a leaf spring 108*b* is secured to the bent piece 108*c*. A connecting pin 107*a* is attached to the lever 107 and inserted through a connecting hole 108*a* in the lever 108**. As shown by dotted lines in FIG. 10(*c*), the connecting pin **107*a* is urged by the leaf spring 108*b* in the transverse direction thereof (as shown by an arrow in the drawing) against a boundary wall of the connecting hole 108*a*. Thus, there occurs no backlash between the connecting pin 107*a* and the connecting hole 108*a***.

In this embodiment, the connecting pin **107*a* and the connecting hole 108*a* in the coupling including the levers 107 and 108 are connected with no backlash under the biasing force of the leaf spring 108*b*, so that control of the secondary throttle valve 2** can be smoothly performed with no hysteresis, improving controllability thereof.

Figure 10A:
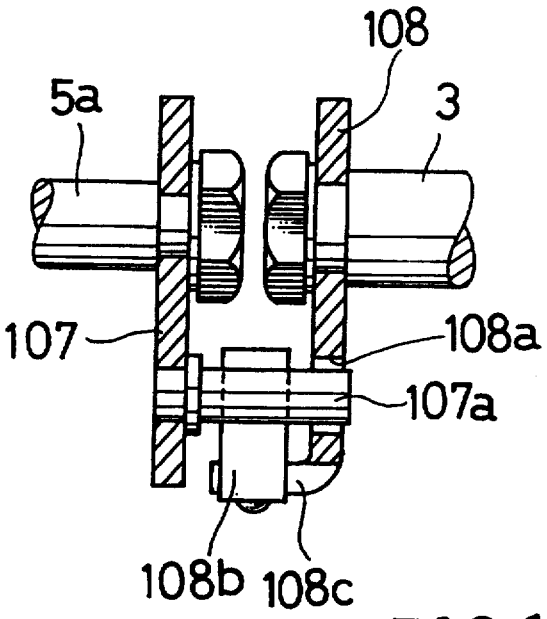
FIGS. 10(*a*), 10(*b*) and 10(*c*) are views illustrating the coupling of the fourth embodiment.
Figure 10B:
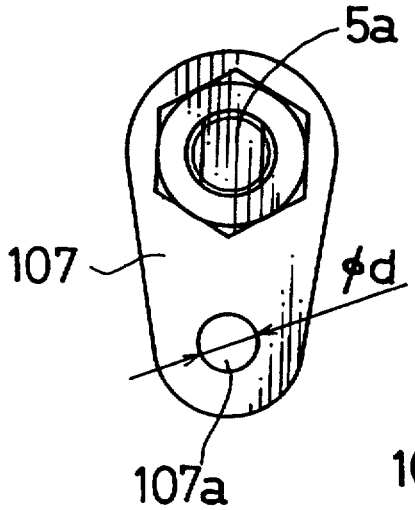
Figure 10C:
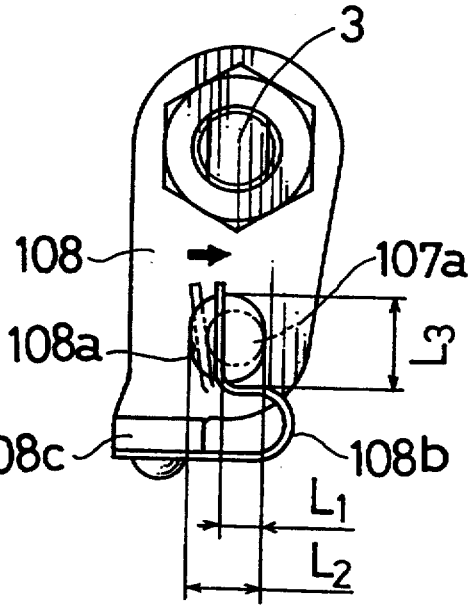

As shown in FIGS. 10(*b*) and 10(*c*), when the diameter of the connecting pin **107*a* is $\phi d$, the diameter of the connecting hole 108*a* in the longitudinal direction of the lever 108 is L3, the diameter of the connecting hole 108*a* in the transverse direction of the lever 108 is L2, and the space between the leaf spring 108*b* in its free condition and the peripheral edge of the connecting hole 108*a* in which the connecting pin 107*a*** is to be inserted is L1, respective values of $\phi d$, L1, L2 and L3 should be set to satisfy the following relationship;

$$L1 < \phi d < L2, \text{ and } \phi d < L3$$

Figure 11B:
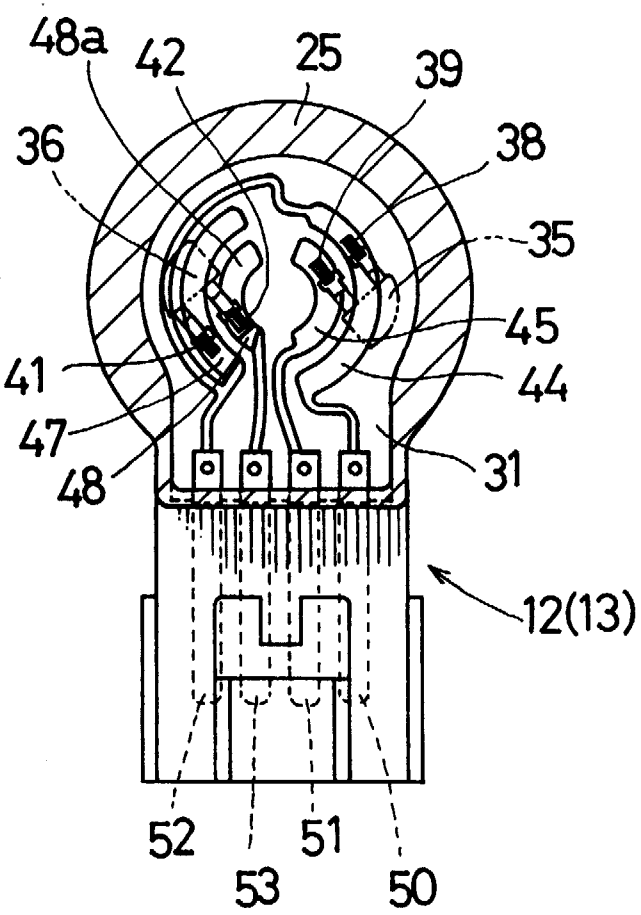
FIGS. 11(*a*) and 11(*b*) are views illustrating a throttle sensor.
Figure 11A:
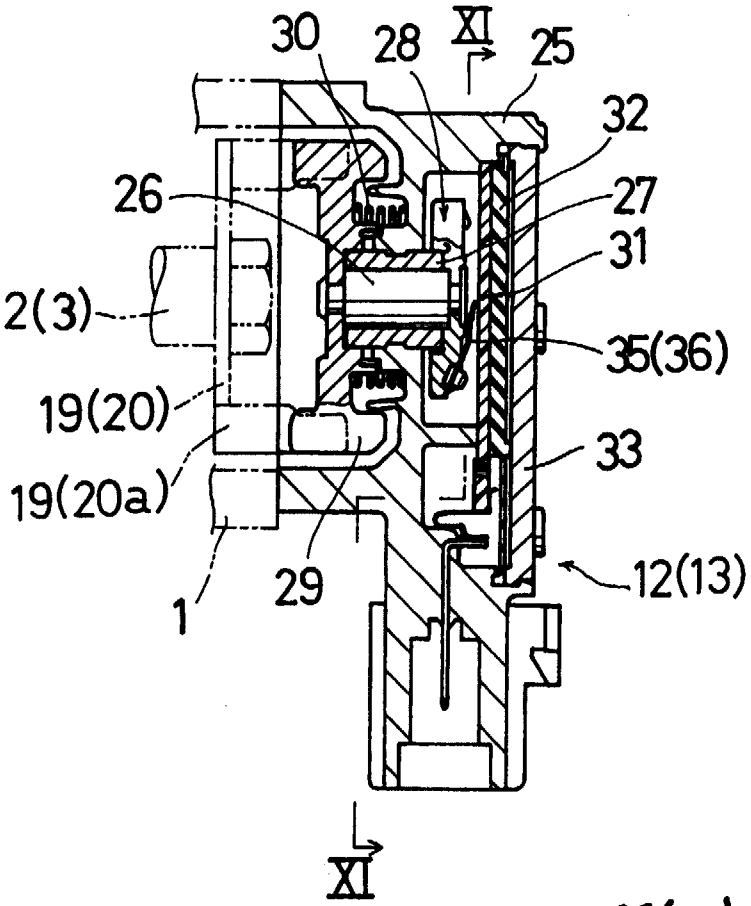

Now, the description will be related to the throttle sensor 12 or 13 operatively associated with the throttle body for traction control with reference to FIG. 11(*a*) which is a sectional view of the sensor and FIG. 11(*b*) which is a sectional view taken along line XI—XI in FIG. 11(*a*). The throttle sensor can be used as the main throttle sensor 13 and, at the same time, as the secondary throttle sensor 12.

As shown in FIG. 11(*a*), the sensor has a casing 25 adapted to be mounted on the throttle body casing 1. The casing 25 encloses a sensor rotor shaft (rotary shaft) 26 which is pivotally movably supported through a bearing 27 in a coaxial relation to the main throttle shaft 11 or the secondary throttle shaft 3. A sensor rotor 28 is fixedly attached to one end (right end in the drawing) of the sensor rotor shaft 26, and an interlocking lever 29 is fixedly attached to the other end of the sensor rotor shaft 26. The interlocking lever 29 is urged under a small force by a torsion coil spring 30 toward a position at which the main throttle valve 10 is fully closed or the secondary throttle valve 2 is fully opened. Under the biasing force of the spring 30, the interlocking lever 29 is engaged with an engaging piece **19*a* or 20*a* of the sensor lever 19 or 20**.

A printed circuit board 31 is fixedly attached in the casing 25 in an opposed relation to the sensor rotor 28. The casing 25 has an opening substantially corresponding to the rear surface of the printed circuit board 31, the opening being closed by a cover 33 with a packing 32 disposed therebetween.

As shown in FIG. 11(*b*), the sensor rotor 28 has a pair of brush holders 35 and 36 disposed in point symmetry. One of the brush holders 35 includes a pair of parallel brushes 38 and 39 and the other brush holder 36 includes a pair of parallel brushes 41 and 42. The brushes 38 and 39, 41 and 42 are electrically connected with each other through the respective brush holders 35 and 36.

The printed circuit board 31 has on its surface facing the sensor rotor 28 printed patterns 44, 45, 47 and 48 with which the brushes 38, 39, 41 and 42 respectively move in sliding contact, when the rotor 28 is pivotally moved. The resistance pattern 44 corresponds to a pivotal path of the brush 38 and is given an electric potential variable at a constant rate in the peripheral direction. The conductor pattern 45 corresponds to a pivotal path of the brush 39. The other two conductor patterns 47 and 48 come in contact with the brushes 41 and 42, respectively, when the main throttle valve 10 is in its fully closed position, or when the secondary throttle valve 2 is in its fully opened position. The conductor pattern 48 has an extension which constitutes an insulator pattern **48*a* for preventing abrasion of the brush 42. The patterns 44, 45, 47 and 48 are electrically connected with terminals 50, 51, 52 and 53, respectively, provided in a connector of the casing 25. Each of the terminals 50, 51, 52 and 53** are electrically connected with corresponding terminals of a connector device (not shown) which is connected with a battery of the automobile and the controller ECU.

A constant voltage (for example 5 V) is applied to the terminal 50 of the throttle sensor 12 or 13. The brushes 38 and 39 slidingly move along the corresponding patterns 44 and 45 in proportion to the opening degree of the throttle valve 2 or 10, and a voltage proportional to the opening degree is transmitted to the controller ECU through the terminal 51.

Figure 12:
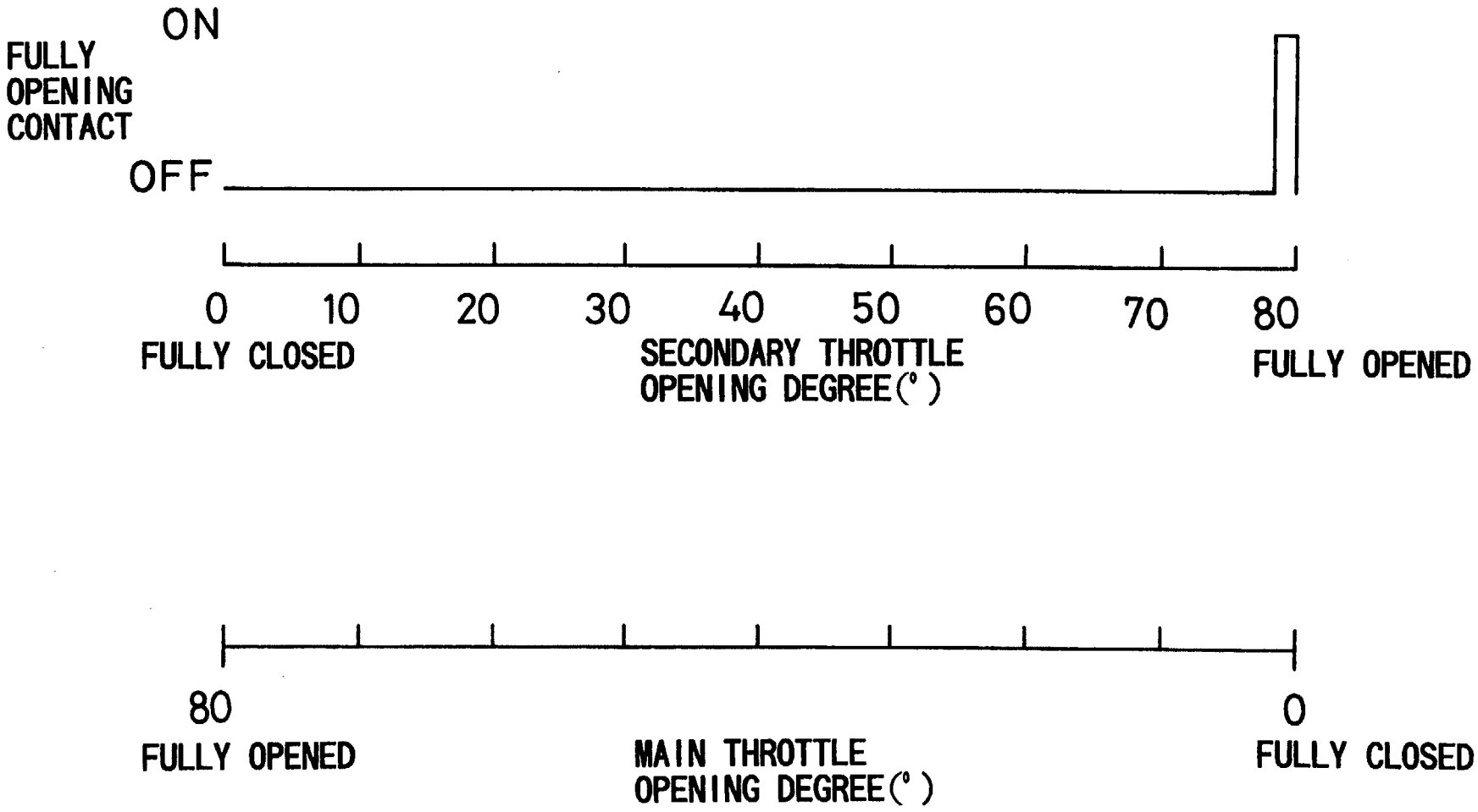
FIG. 12 is a diagram illustrating the output signal from a fully opened/fully closed condition detecting switch of the throttle sensor.

When the main throttle valve 10 is fully closed, or when the secondary throttle valve 2 is fully opened, the brushes 41 and 42 come in contact with the corresponding conductor patterns 47 and 48, so that the terminals 52 and 53 are electrically connected with each other. This connection is converted into a main throttle valve fully closed condition signal or a secondary throttle valve fully opened condition signal, which is transmitted to the controller ECU. This combination of the brushes 41, 42 and the conductor patterns 47, 48 serves as a main throttle valve fully closed condition detecting switch or a secondary throttle valve fully opened condition detecting switch. As shown in the operational diagram in FIG. 12, this switch becomes "ON" when the opening degree of the secondary throttle valve 2 (secondary throttle opening degree) is at its fully opened position, that is, at an angle of 80 degrees, and becomes "OFF" in the other positions. In FIG. 12, the secondary throttle opening degree is indicated from 0 degree at its fully closed position to 80 degrees at its fully opened position where the secondary throttle valve 2 is in parallel to the symmetric axis C1 of the throttle bore 16, as shown in FIG. 2. In case the throttle sensor is used as the main throttle sensor 13, the switch becomes "ON" when the main throttle valve 10 is in its fully closed position, and becomes "OFF" in the other positions.

Figure 13:
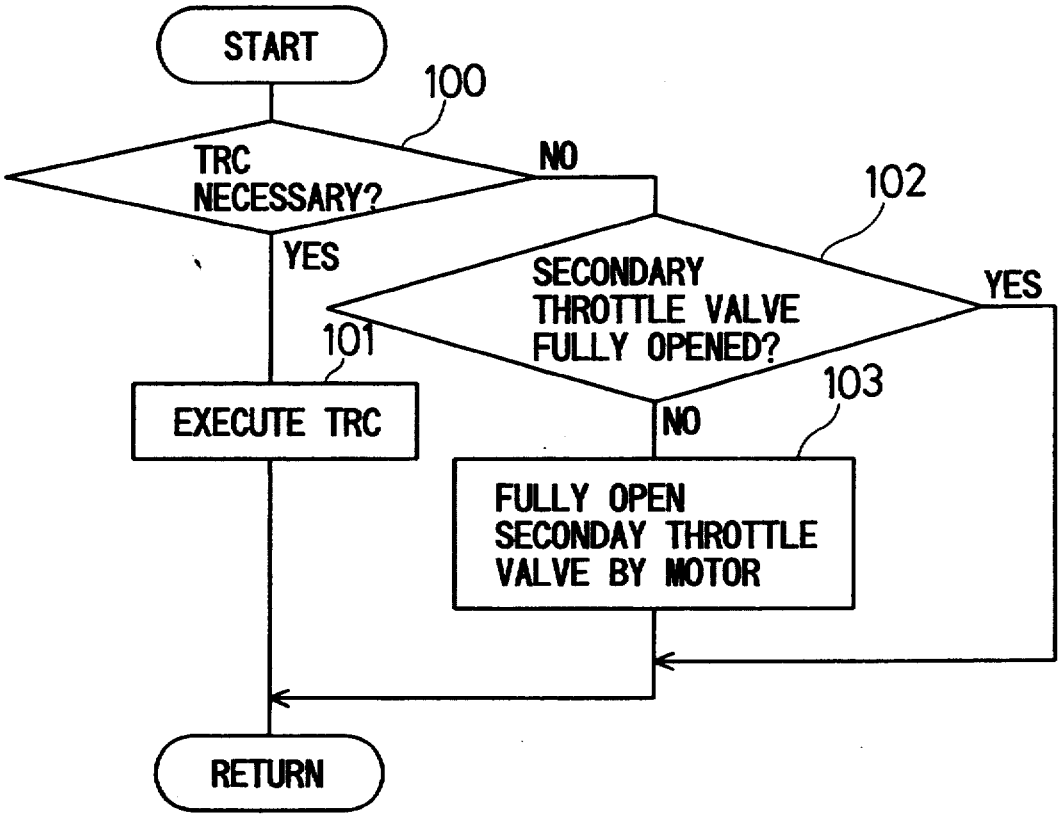
FIG. 13 is a flow chart illustrating a process of verifying full-opening of the secondary throttle valve.
Figure 14A:
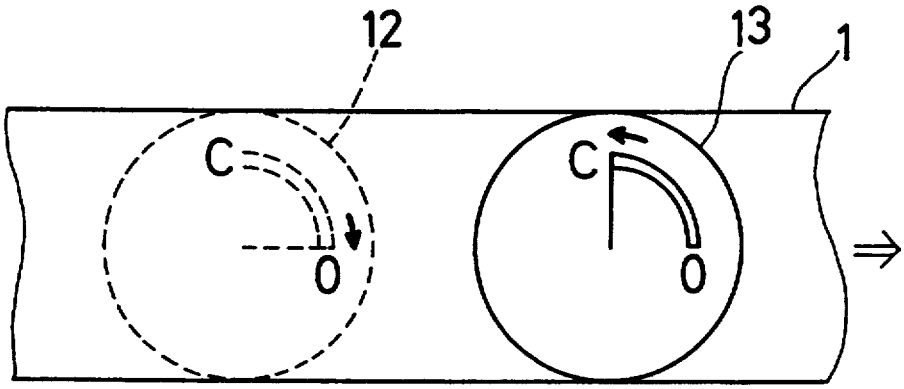
FIG. 14(*a*), 14(*b*), 14(*c*) and 14(*d*) are views showing that the same throttle sensor can be used as a main throttle sensor and, at the same time, as a secondary throttle sensor.
Figure 14C:
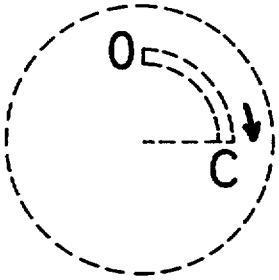
Figure 14B:
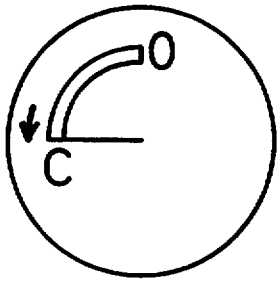
Figure 14D:
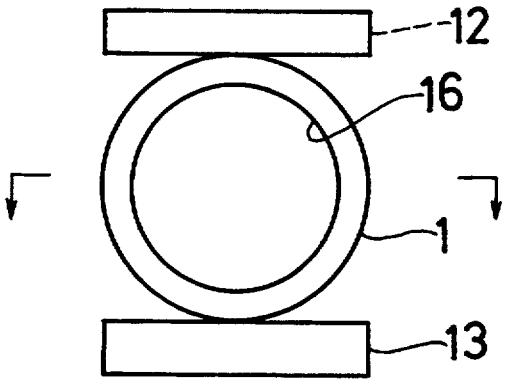

Now, a process for verifying the fully opened condition of the secondary throttle valve 2 by the controller ECU will be explained with reference to FIG. 13 which shows a flow chart of the process.

The process is started on turning of an ignition switch of the automobile. First of all, in Step 100, the controller ECU discriminates whether traction control (TRC) is necessary or not, and if it discriminates as "yes", TRC is executed and the process ends in Step 101.

If TRC is not necessary, the controller ECU discriminates, in Step 102, whether the secondary throttle valve is in its fully opened condition or not. If the controller ECU discriminates that the secondary throttle valve 2 is in its fully opened condition based on the secondary throttle fully opened condition detecting switch, the process ends. If the controller ECU discriminates that the secondary throttle valve 2 is not in its fully opened condition, the controller ECU directs the motor 6 to open the secondary throttle valve 2 in Step 103.

Thus, in case of no TRC required, even if the secondary throttle valve 2 is moved from its fully opened position due to disturbance such as abnormal vibration and impact, the secondary throttle valve 2 can be returned to its fully opened condition in accordance with the above process, and a subsequent traction control can be always referenced from the fully opened position. Thus, the present invention can avoid any fear of erroneous control referenced from a displaced position as occurred in the prior art, and consequently, any abnormal control caused by fluctuation of the number of steps of the motor for control.

In the apparatus shown in FIG. 1, the same throttle sensor is used as the main throttle sensor 13 and, at the same time, as the secondary throttle sensor 12. Such a flexible use of the same sensor will be described.

In FIG. 14(*a*) diagrammatically showing the sensors as viewed from the left side in FIG. 1, when the main throttle sensor 13 is installed, the main throttle valve 10 is in its fully closed position under the biasing force of the return spring 18. At this time, the throttle sensor 13 must be rotatable between the fully closed position C and the fully opened position 0 and be urged by the spring 30 toward one of the positions. If it is urged toward its fully opened position, the sensor lever 19 cannot be engaged with the interlocking lever 29, and so, it must be urged toward the fully closed position. If the same throttle sensor is used as the secondary throttle sensor and mounted on the same side of the throttle body casing 1 as the main throttle sensor, the sensor lever 20 cannot be engaged with the interlocking lever 29, since the secondary throttle valve 2 is urged toward its fully opened position.

In order to overcome this problem, the main throttle sensor 13 and the secondary throttle sensor 12 are disposed on opposite sides of the throttle bore 16 or the throttle body casing 1. In this way, the interlocking lever 29 can be engaged with either of the sensor levers 19 and 20 under the biasing force of the spring 30. Furthermore, it should be noted that the fully closed position of the main throttle valve 10 corresponds to the fully opened position of the secondary throttle valve 2. This means that the same sensor can detect both of the fully closed condition of the main throttle valve 10 and the fully opened condition of the secondary throttle valve 2.

FIG. 14(*b*) shows the main throttle sensor 13 rotated in the counterclockwise direction through 90 degrees, and FIG. 14(*c*) is a view of the main throttle sensor 13 in FIG. 14(*b*) as viewed from the back side. As is apparent from the drawing, the same throttle sensor can be used as the main throttle sensor 13 and, at the same time, as the secondary throttle sensor 12. As is apparent from FIGS. 14(*a*) and 14(*c*), the opening degree signals taken out from the terminal 51 will be inverted, which will be properly processed by the controller ECU.

While the invention has been described with reference to preferred embodiments thereof, it is to be understood that modifications or variations may be easily made without departing from the scope of the present invention which is defined by the appended claims.

What is claimed is:

1. A throttle body for traction control comprising:

a substantially cylindrical throttle body casing having a throttle bore extending therethrough;

a main throttle shaft extending across said throttle bore of said throttle body casing and rotatably supported by said throttle body casing;

a main throttle valve rotatable with said main throttle shaft to open and close said throttle bore of said throttle body casing;

an accelerator lever connecting said main throttle shaft and an accelerator cable;

a secondary throttle shaft extending across said throttle bore of said throttle body casing and rotatably supported by said throttle body casing;

a secondary throttle valve rotatable with said secondary throttle shaft to open and close said throttle bore of said throttle body casing; and a motor adapted to rotate said secondary throttle shaft for opening and closing said secondary throttle valve;

said motor for opening and closing said secondary throttle valve having an output shaft coaxially disposed with said secondary throttle shaft;

said output shaft and said secondary throttle shaft being connected by means of a coupling which can transmit torque therebetween;

said secondary throttle shaft being offset from the axis of symmetry of said throttle bore of said throttle body casing;

said secondary throttle valve being divided by said secondary throttle shaft and defining a section which is longer in dimension from said secondary throttle shaft to the end of the secondary throttle valve and another section which is shorter, said longer section being disposed downstream in air flow, whereby air flowing through said throttle bore of said throttle body casing exerts on said secondary throttle valve a force acting to open the same.

2. The throttle body as defined in claim 1, wherein:

said output shaft of said motor and said secondary throttle shaft have respective levers radially extending and mounted on their corresponding ends opposite to each other;

one of said levers has a pin fixedly attached thereto and extending parallel to the common axis of said shafts;

the other lever has a hole through which said pin is inserted; and said pin is urged by a spring against a wall defining said hole of said other lever.

3. The throttle body as defined in claim 1, wherein:

said secondary throttle shaft has a secondary throttle sensor attached to an end thereof apart from said motor; sensor attached to an end thereof apart from said motor;

said secondary throttle sensor has a rotary shaft coaxially disposed with said secondary throttle shaft; and said rotary shaft and said secondary throttle shaft are connected by means of a coupling which can transmit torque therebetween.

4. The throttle body as defined in claim 3, wherein:

said main throttle shaft has a main throttle sensor attached to an end thereof;

said main throttle sensor and said secondary throttle sensor are disposed on opposite sides of said throttle body casing; and said main throttle sensor and said secondary throttle sensor are of the same type of throttle sensor.

5. The throttle body as defined in claim 4, wherein said throttle sensor of the same type includes a switch:

when the throttle sensor is used as said main throttle sensor, the switch produces a signal when said main throttle valve is in its fully closed position and a different signal when it is in the other positions; and when the throttle sensor is used as said secondary throttle sensor, the switch produces a signal when said secondary throttle valve is in its fully opened position and a different signal when it is in the other positions.

6. The throttle body as defined in claim 3, wherein said secondary throttle sensor includes a switch which produces a signal when said secondary throttle valve is its fully opened position and a different signal when it in the other positions.

* * * * *